US005145032A

United States Patent [19]

Puccinelli et al.

[11] Patent Number: 5,145,032

[45] Date of Patent: Sep. 8, 1992

[54] MASON'S SCAFFOLD

[75] Inventors: Joseph S. Puccinelli, Brown Deer; Peter T. Foseid, Milwaukee; Stig Karlsen, Burlington, all of Wis.

[73] Assignee: Figgie International, Inc., Willoughby, Ohio

[21] Appl. No.: 613,342

[22] Filed: Nov. 13, 1990

[51] Int. Cl.[5] ..... E04G 1/18

[52] U.S. Cl. ..... 182/142; 182/119

[58] Field of Search ..... 182/142, 146, 148, 141, 182/143, 132; 14/69.5

[56] References Cited

U.S. PATENT DOCUMENTS

| | | | |
|---|---|---|---|
| 66,286 | 7/1867 | Best | 182/146 |
| 1,725,183 | 8/1929 | Fischer | 182/142 |
| 2,600,199 | 6/1952 | Brewster | 182/142 X |
| 3,837,428 | 9/1974 | Gish | 182/142 X |
| 4,825,976 | 5/1989 | Wyse | 182/119 X |
| 4,830,144 | 5/1989 | Werner | 182/119 X |
| 4,959,941 | 10/1990 | Schoeneberg | 182/119 X |
| 4,997,062 | 3/1991 | Pizzo | 182/132 |

*Primary Examiner*—J. Franklin Foss

*Attorney, Agent, or Firm*—Paul R. Puerner

[57] ABSTRACT

Standard platforms are integrated into a mason's scaffold to reduce manufacturing and assembly costs. The standard platforms having hooks on both ends. The hooks are supported on lower horizontal members of respective rectangular frames. Platform fasteners are secured to each lower horizontal member with the standard platform hooks therebetween, thereby retaining the standard platforms to the frames to form a working deck. Each platform fastener comprises a metal sheet to which is welded an L-shaped bar that engages a hole in the frame lower horizontal member. A pin slides within the metal sheet and cooperates with the bar to positively secure the platform fastener to the frame lower horizontal member. Similar standard platforms and platform fasteners are assembled to upper horizontal members of the frames to form a protective canopy. Hatches with selectively openable doors may be used for some sections of the canopy. The present invention further comprises fairleads for guiding the cables from which the mason's scaffold is suspended from a building or the like.

21 Claims, 3 Drawing Sheets

MASON'S SCAFFOLD

BACKGROUND OF THE INVENTION

1. Field of the Invention

This invention pertains to work stations, and more particularly to apparatus for supporting personnel and materials during building construction.

2. Description of the Prior Art

Various equipment has been developed to enable persons to work on the outside of a building under construction. For example, multi-point mason's scaffolds are in widespread use.

Mason's scaffolds normally include a series of sturdy frames that are suspended from the building itself by flexible cables. To the frames are assembled numerous other components, including work decks, safety railings, and overhead canopies. The scaffold cables have respective ends that are normally tied to beams that are firmly anchored to an upper story of the building and that overhang the buidling wall. Power or manually operated winches or hoists are used both to attach the cables to the scaffold frames and to raise and lower the scaffold along the building wall. Scaffolds can be 5 feet or more in length, and they are able to safely carry personnel, equipment, and materials.

Despite their general acceptance in the construction industry, multi-point mason's scaffolds possess some disadvantages. The assembly of a mason's scaffold is a major undertaking. The decks, guard rails, and other components must be securely and safely assembled to the frames. Prior scaffolds require that the work decks and other components be custom built for each particular scaffold. The special components are time-consuming and thus expensive both to produce and to assemble into a scaffold. Although some types of standard work platforms are available, they have not been successfully integrated into prior mason's scaffolds.

In addition, it is a major task in prior mason's scaffolds to load materials and equipment onto them by means of an overhead crane. That is because the canopy must be disassembled above the area of the work deck to be loaded, and subsequent to loading, the canopy must be reassembled.

Thus, a need exists for improvements in mason's scaffolds.

SUMMARY OF THE INVENTION

In accordance with the present invention, a mason's scaffold is provided that integrates various components into a less costly and more versatile system than was previously possible. This is accomplished by apparatus that includes platform fasteners that retain standard platforms to the scaffold frames in a safe and efficient manner.

The scaffold frames are preferably fabricated as two spaced vertical frame members joined by upper and lower horizontal frame members. The upper and lower horizontal frame members include vertically oriented plates. A number of frames can be used, and they are spaced apart by the length of the standard platforms.

The standard platforms are usually made of aluminum and have a smooth working surface. Two or more hooks protrude from each end of the standard platforms. The standard platforms extend between adjacent frames, and their hooks rest on and are supported by the vertically oriented plates of the lower horizontal frame members of respective frames. Two or more standard platforms can be placed side-by-side between two frames to make a working deck of the desired width. The standard platform hooks are arranged to enable the standard platforms to be placed end to end on a frame lower horizontal member and extend oppositely from that frame.

To safely retain the standard platforms to the associated frame lower horizontal member, a platform fastener according to the present invention overlies the lower horizontal member of each frame and the corresponding hooks of the standard platforms supported on that lower horizontal frame member. The platform fastener is comprised of a metal sheet having a length generally equal to the total width of the standard platforms on the frame. The platform fastener metal sheet is wide enough to completely cover the hooks at the ends of the standard platforms. Consequently, the platform fastener metal sheet cooperates with the top surfaces of the standard platforms to provide a continuous smooth surface for personnel working on the scaffold.

The platform fastener of the present invention further comprises two or more generally L-shaped bars. The fixed leg of each bar is welded to the underside of the platform fastener metal sheet. The bars are designed such that their fixed legs are proximate one side of the frame lower horizontal member and their free legs are receivable within respective holes in the vertical plate of the lower horizontal frame member when the platform fastener metal sheet rests on the standard platform over the hooks between adjacent standard platforms. The platform fastener further comprises a short tube welded to the metal sheet proximate each L-shaped bar. A pin is captured but free to slide within each tube, and the pin also passes through the platform fastener metal sheet. The pins are manually pulled upwardly relative to the platform fastener metal sheet and the bars when the platform fastener is assembled to the frame in order to allow the platform fastener to be slid horizontally and the free legs of the bars to be inserted into the corresponding holes in the vertical plate of the frame lower horizontal member. When the bar free legs are within their associated holes in the lower horizontal member vertical plate, the pins are released to fall by gravity so as to lie alongside the vertical plate and on the opposite side thereof as the bars. Consequently, the pins and bars cooperate to secure the platform fastener to the frame in six degrees of freedom. Should it become necessary to remove a standard platform, the pins in the platform fastener are merely pulled through the metal sheet so as to enable the platform fastener to be slid horizontally to remove the bar free ends from the holes in the lower horizontal member vertical plate. Then the platform fastener can be lifted vertically away from the standard platform and the underlying lower horizontal member.

Further in accordance with the present invention, the mason's scaffold employs a protective canopy that is composed of the same standard platforms and platform fasteners as the work deck. For that purpose, the upper horizontal member of each frame is fabricated generally similar to the frame lower horizontal member, including having a vertically oriented plate with holes for receiving the free legs of the platform fasteners.

The present invention is further concerned with hatches in the overhead canopy that enable equipment and material to be loaded on the work deck with an overhead crane. The hatches are assembled to and extend between selected frames in place of the standard platforms. The hatches include at least one door. In normal use, the door is supported horizontally on end supports that form a portion of the hatch. The doors thereby provide overhead protection for the personnel working on the deck. The pivotable nature of the hatch door allows it to be temporarily opened such that the deck can be loaded from above.

It is a feature of the present invention that the suspension cables are efficiently assembleable to the scaffold frames, and further that the scaffold frames guide the cables with minimum play and wear. That is achieved by passing the cables through clearance holes of respective guide blocks. The guide blocks fit and are fastened within respective complementary openings in the scaffold frames. The frame openings are large enough to allow passage therethrough of the thimbles at the cable ends that are used to tie the cables to support beams anchored to the building from which the mason's scaffold is suspended. That construction greatly facilitates assembly of the scaffold to the cables while maintaining satisfactory cable guidance.

Additional advantages, benefits, and features of the present invention will become apparent to those skilled in the art upon reading the detailed description of the invention.

DETAILED DESCRIPTION OF THE INVENTION

General

Figure 1:
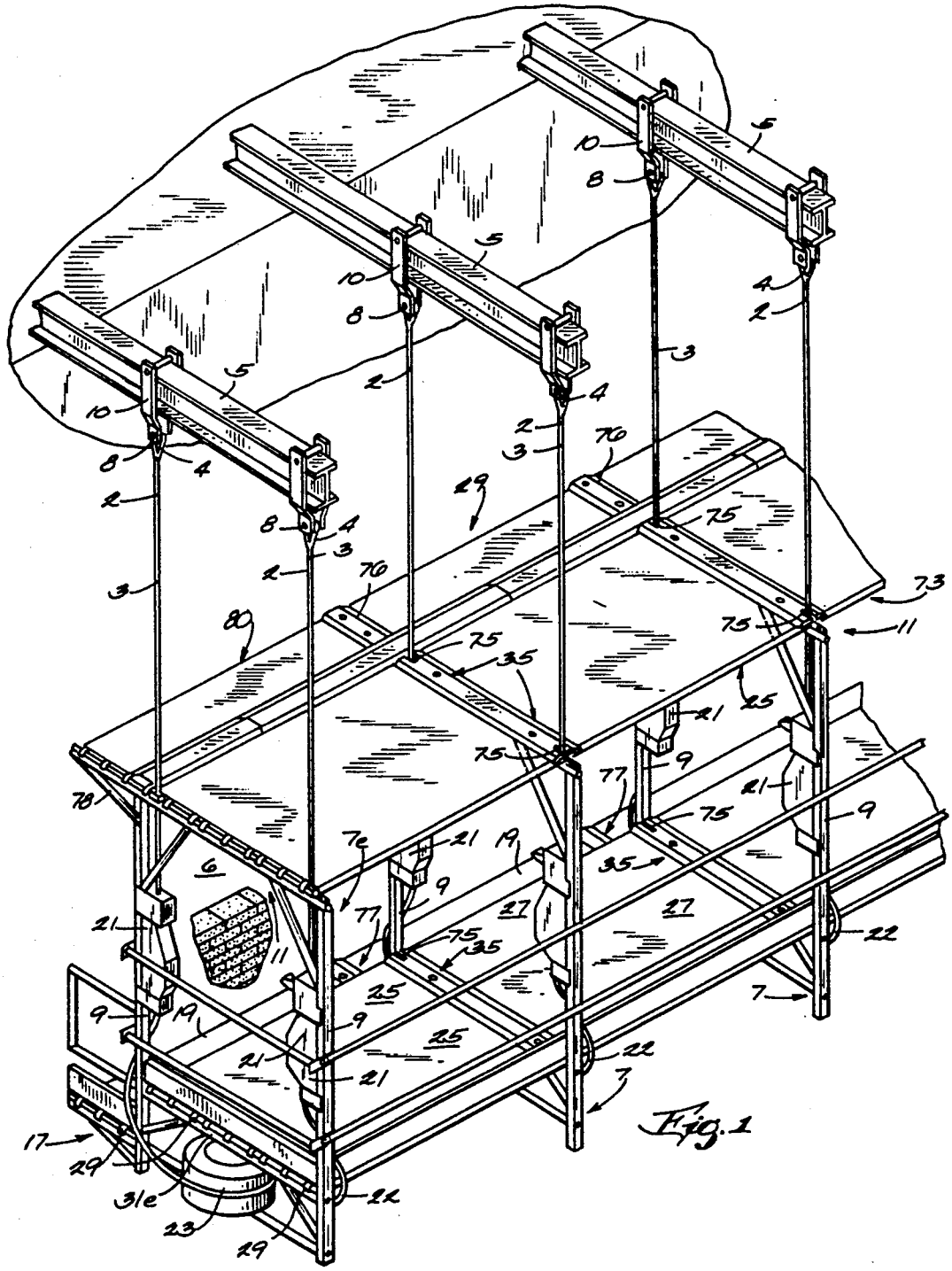
FIG. 1 is a perspective view of the mason's scaffold of the present invention.

Referring to FIG. 1, a mason's scaffold 1 is illustrated that includes the present invention. The mason's scaffold is particularly useful for supporting men, equipment, and materials during construction of a tall building 6, but it will be understood that the invention is not limited to construction applications.

The mason's scaffold 1 is suspended by a number of flexible wire cables 3 from heavy beams 5. The beams 5 are anchored to the building 6 and overhang the building wall. One end 2 of each cable 3 terminates at a thimble 4, through which is inserted a stud 8. The stud 8 forms part of a bracket 10 that ties the cable end 2 to a beam 5. There are at least two cables 3 tied to each beam.

Frame

Figure 2:
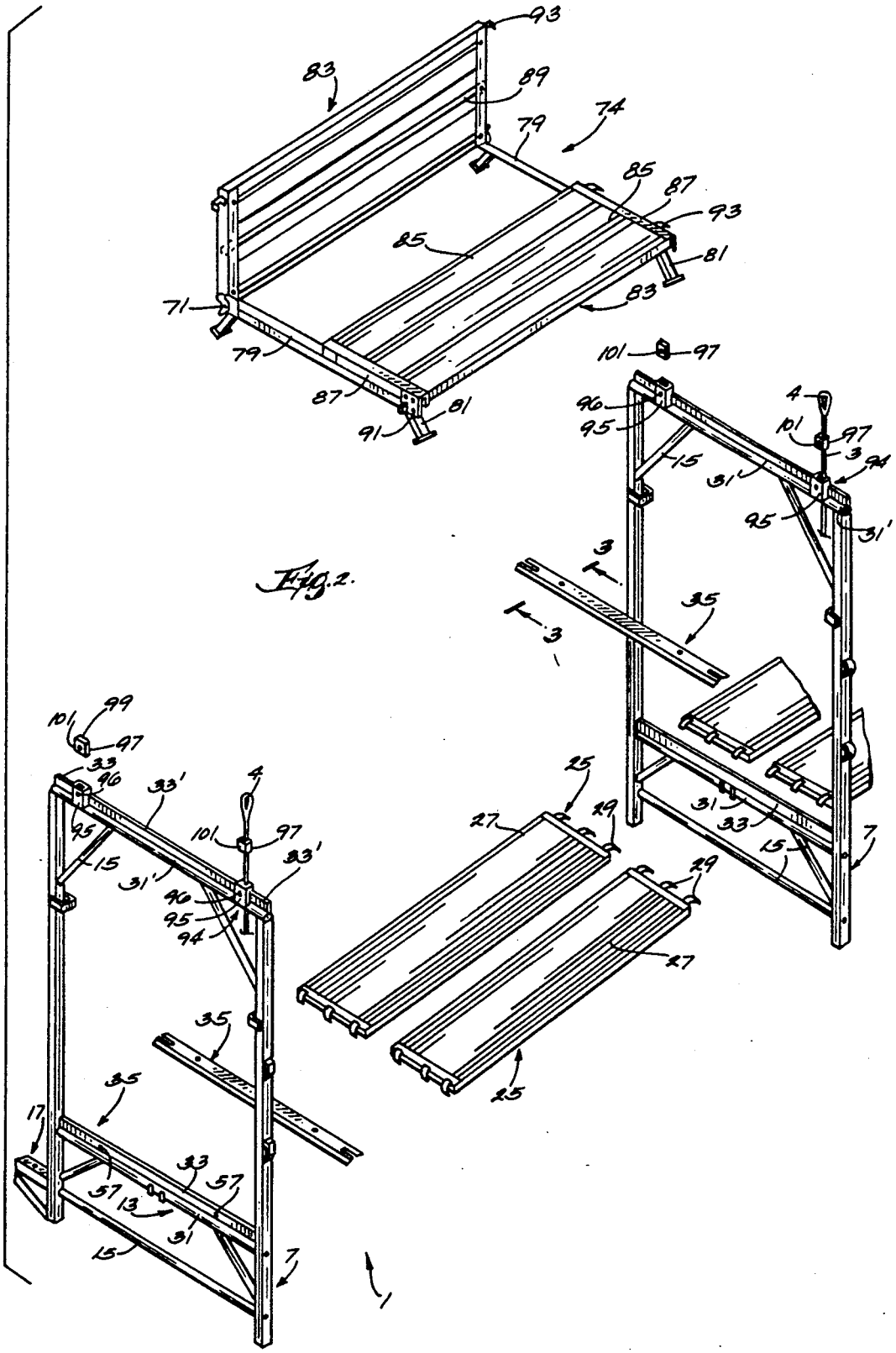
FIG. 2 is an exploded perspective view of a representative portion of the mason's scaffold.

Looking also at FIG. 2, the mason's scaffold 1 is comprised of a number of rectangular modular frames 7. Each frame 7 has a pair of spaced vertical members 9 and upper and lower horizontal members 11 and 13, respectively. The frame members 9, 11, and 13 are welded or otherwise joined together with stiffening braces typically represented at reference numerals 15 into a sturdy frame 7. Relatively short side brackets 17 can be placed at a lower level than the lower horizontal frame members 13 extend between each frame 7 and building 6. Brackets 17 can be used on the inside and outside at both the lower level and the canopy level.

The mason's scaffold frames are held to the cables 3 by means of respective manual or power operated winches 21. The trailing ends 22 of the cables are wound onto cable winders 23, as are known in the art.

Standard Platform

In accordance with the present invention, the mason's scaffold 1 integrates a number of standard platforms 25 into the frames 7. For that purpose, the lower horizontal frame members 13 are manufactured with tubular components 31 to which are welded vertically oriented plates 33. The use of plates 33 facilitates vertical adjustment of frame 7. The vertical plates 33 define transverse holes 57. The side brackets 17 are constructed in a manner generally similar to the lower horizontal frame members 13.

The standard platforms 25 are usually made primarily of aluminum. Each standard platform 25 has at least two hooks 29 extending longitudinally from each end. The standard platforms are easily and quickly assembled to the frames 7 by placing the standard platform hooks 29 to rest on and be supported by the vertical plates 33 of the lower horizontal members 13 of adjacent frames 7. The standard platforms 25 thus extend longitudinally between frames to serve as a working deck 27. Further, the standard platforms define the spacings between adjacent frames. Standard platforms are also supported on and extend between the side brackets 17 to form a step-down platform 19.

Platform Fastener

To safely retain the standard platforms 25 in place on the frames 7, the present invention further comprises a series of platform fasteners 35. A platform fastener 35 is used in conjunction with each lower horizontal frame member 13 to overlie the hooks 29 of all the standard platforms supported on that frame member.

Figure 3:
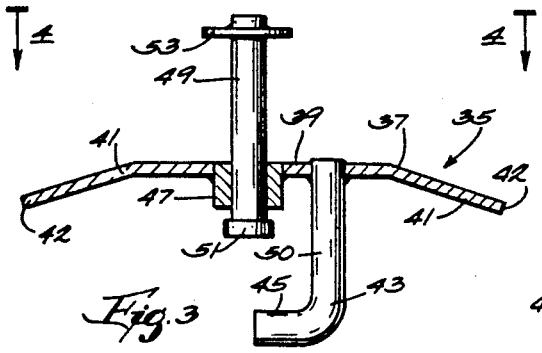
FIG. 3 is an enlarged cross-sectional view taken along lines 3—3 of FIG. 2.
Figure 4:
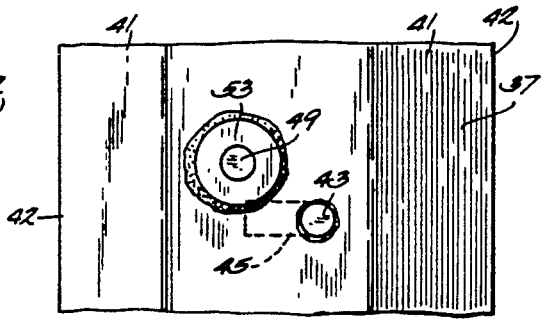
FIG. 4 is a view taken along lines 4—4 of FIG. 3.

With particular attention to FIGS. 3 and 4, each platform fastener 35 is comprised of a metal sheet 37 that may be bent into a center section 39 and two angled end sections 41. Each angled end section 41 terminates in a longitudinal edge 42. To the underside of the metal sheet center section 39 is welded or otherwise joined at least two generally L-shaped bars 43. Each L-shaped bar 43 has a free leg 45 that extends generally parallel to the metal sheet center section.

Figure 5:
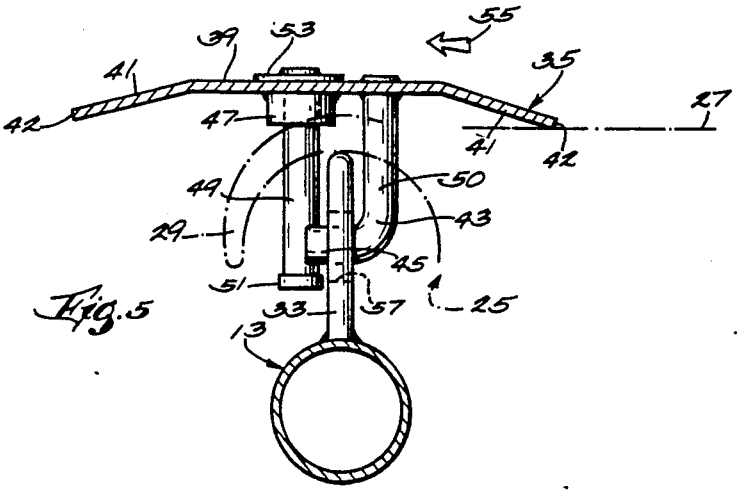
FIG. 5 is a view similar to FIG. 3, but showing the platform fastener secured to the frame.

Also welded to the underside of the metal sheet 37 in association with each bar 43 is a short tube 47. The tubes 47 and coincident holes in the metal sheet loosely accept respective pins 49. A shoulder 51 on one end of each pin 49 and a washer 53 welded to the other end of the pin slidingly capture the pin in its tube and the metal sheet. The associated bars 43 and pins 49 are spaced apart transversely on the metal sheet 37 such that the vertical plate 33 of a lower horizontal member 13 can fit between them, FIG. 5. Further, the bars 43 and pins 49 are located so as to fit between the hooks 29 of the various standard platforms 25 that are supported on the vertical plate 33 of the lower horizontal member 13 when the platform fastener 35 overlies that lower horizontal member and the standard platform hooks supported on it.

The platform fastener 35 is assembled to a frame 7 by manually lifting the pins 49 to the position shown in FIG. 3. The platform fastener is lowered onto the standard platforms 25 supported on the frame, with the bars 43 and pins 49 passing between the hooks 29 of the standard platforms, until the edges 42 of the metal sheet 35 contact the standard platforms. Then the platform fastener is slid horizontally in the direction of arrow 55, FIG. 5, until the free ends 45 of the bars 43 enter respective holes 57 in the frame vertical plate 33. The pins 49 are released to fall by gravity until the washers 53 contact the platform fastener metal sheet 37. The fixed legs 50 of the bars 43 cooperate with the pins 49, and the bar free legs 45 cooperate with the vertical plate holes 57 to secure the platform fastener to the frame in all six degrees of freedom. As a consequence, the standard platforms 25 between the platform fastener and the lower horizontal member 13 are also retained to the scaffold frames 7 in a safe and efficient manner.

Figure 6:
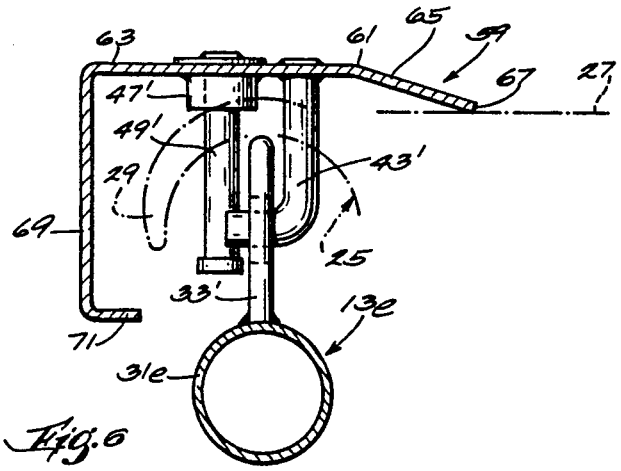
FIG. 6 is a view similar to FIG. 5, but showing a modified embodiment of the platform fastener of the present invention.

Turning to FIG. 6, a modified platform fastener 59 is depicted. The platform fastener 59 is generally similar to the platform fastener 35 described previously, having L-shaped bars 43', tubes 47', and sliding pins 49'. However, the platform fastener 59 is used in conjunction with the end frames of the scaffold 1, such as frame 7*e* of FIG. 1. Standard platforms 25 extend in only one direction from the lower horizontal member 13*e* of the end frame 7*e*. To suit that situation, the end platform fastener 59 has a metal sheet 61 with a flat center section 63 and an angled end section 65, which has a longitudinal edge 67 that rests on the standard platforms 25. The end platform fastener also has a vertical wall 69 depending from the flat center section 63 and on the opposite side thereof as the angled end section 65. The free end of the wall 69 terminates in an inturned horizontal wall 71. The platform fastener 59 thus presents a neat and finished appearance in addition to providing safe retention of the standard platforms to the scaffold end frame 7*e*.

Platform fasteners 77 are employed with the standard platforms of the step-down platform 19. The platform fasteners 77 are generally similar to the platform fasteners 35 described previously, but they are usually shorter to accommodate the fewer standard platforms that normally make up the relatively narrow step-down platform.

Canopy and Hatch

Further in accordance with the present invention, the platform fasteners 35 and 59 may be integrated with standard platforms 25 to form a protective canopy 73 for the work deck 27, FIG. 1. For that purpose, the upper horizontal members 11 of the frame 7 are manufactured in a generally similar manner to the lower horizontal members 13. That is, each upper horizontal frame member has a tubular member 31' to which is welded a vertically oriented plate 33'. The hooks 29 of the standard platforms 25 used in the canopy 73 are supported on the upper horizontal member plates 33'. Platform fasteners 35 are secured to the upper horizontal members with the standard platform hooks therebetween in a similar manner to that described previously in connection with the standard platforms and platform fasteners used for the work deck 27.

To provide passage for the cables 3 passing through the canopy 73, the ends of each platform fastener 35 are longitudinally slit, as at reference numeral 75. Shorter but otherwise similar platform fasteners 76 are used with standard platforms 25 and relatively short side brackets 78 to form a canopy 80 for the step-down platform 19.

It is a feature of the present invention that one or more hatches can be built into the scaffold canopy 73. Hatches are highly desirable to enable materials and equipment to be loaded onto the scaffold deck 27 from above with an overhead crane, not shown. With particular attention to FIG. 2, a hatch 74 may replace the standard platforms 25 that form the canopy 73 between two frames 7. In the illustrated construction, the hatch 74 comprises a pair of spaced end supports 79 having legs 81 that are suitably assembled to respective scaffold frames 7. A pair of doors 83 are pivotally mounted between the end supports 79. Each door 83 comprises one or more platforms 85. The platforms 85 are generally similar to the standard platforms 25, but they are modified slightly in that the hooks 29 are removed. The ends of the platforms 85 are firmly fastened to respective channels 87. To provide an exceptionally strong and rigid door 83, one or more structural tie rods 89 may be used to tie the two channels 87 of each door together.

To permit opening and closing of the doors 83, the channels 87 of each door are hinged at 91 to corresponding opposed ends of the end supports 79. Short angles 93 welded to the door channels 87 at the ends opposite the hinges 91 locate the doors in the closed position by resting on the hatch end supports 79. In that manner, overhead protection is provided to workers on the deck 27 when the hatch doors are closed, but the hatch can be easily opened for overhead loading and unloading of the deck 27 with materials and equipment.

Cable Fairlead

With particular attention to FIG. 2, the present invention is further concerned with a fairlead 94 for guiding the mason's scaffold 1 along the cables 3. It will be noticed that the upper horizontal member 11 of each frame 7 is fabricated with a pair of short vertically oriented tubes 95. The tubes 95, which preferably have rectangular cross sections, are welded between three sections of the tube 31' and corresponding vertical plates 33'. The tubes 95 are large enough to allow passage of the cable thimbles 4 through them. Each tube 95 has a horizontal hole 96 through two opposed walls. The tubes 95 loosely receive complementary shaped blocks 97. Each block 97 is made from hardened steel and has a vertical hole 99 through it. The block vertical hole 99 is sized to receive a cable 3. Each block also has a horizontal through hole 101 that is alignable with the tube holes 96 when the block is received within the tube.

At assembly of the mason's scaffold 1, the trailing end 22 of a cable 3, which usually has a thimble 4 in place on the opposite end 2, is threaded through the hole 99 of a block 97. The cable end 22 is then connected to the correct winch 21. The block 97 is thus captured on the cable. The thimble is passed through the appropriate frame tube 95, and the block is slid inside the corresponding tube. With the tube hole 96 and the block hole 101 in alignment, a screw and nut (or pin), not illustrated in the drawings, are used to fasten the block to the upper horizontal frame member 11. In that manner, the tubes and blocks cooperate to create fairleads 94 for the respective cables. Further, the block and tube design enables the cables to be efficiently assembled and disassembled into the frames 7.

Thus, it is apparent that there has been provided, in accordance with the invention, a mason's scaffold that fully satisfies the objects, aims, and advantages set forth above. While the invention has been described in conjunction with specific embodiments thereof, it is evidence that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A mason's scaffold suspendable from a building by a plurality of cables comprising:

a. at least two frames, each frame having a pair of vertical members and upper and lower horizontal members extending between and joined to the vertical members to form a generally rectangular frame;

b. at least one standard platform extending between the frames, the standard platform having hooks on the opposite ends thereof that rest on and are supported by the lower horizontal members of the respective frames to thereby create a deck between the frames; and c. at least two platform fasteners overlying and being unsecured to portions of the standard platform deck adjacent the hooks and overlying and being removably secured to respective frame lower horizontal members with the hooks of the standard platform between the platform fastener and the frame lower horizontal members, so that the standard platforms are positively retained to the frames by the platform fasteners.

2. A mason's scaffold suspendable from a building by a plurality of cables comprising:

a. at least two frames, each frame having a pair of vertical members and upper and lower horizontal members extending between and joined to the vertical members to form a generally rectangular frame, the lower horizontal member of each frame being comprised of a vertically oriented plate extending between and joined to the vertical frame members;

b. at least one standard platform extending between the fames, the standard platform having hooks on the opposite ends thereof that rest on and are supported by the lower horizontal members of the respective frames to thereby create a deck between the frames, wherein the hooks of the standard platform rest on and are supported by the vertical plate of the lower horizontal member; and c. at least two platform fasteners overlying and being secured to respective frame lower horizontal members with the hooks of the standard platform therebetween, wherein each platform fastener comprises:

i. a metal sheet that rests on the standard platform and that overlies the standard platform hooks, the metal sheet having a top surface and an undersurface;

ii. bar means joined to the metal sheet undersurface for cooperating with an associated frame lower horizontal member to partially secure the platform fastener to the frame; and iii. pin means slidable within the metal sheet for cooperating with the bar means to completely secure the platform fastener to the frame, so that the standard platforms are positively retained to the frames by the platform fasteners, and so that securing the platform fastener to the frame also positively retains the standard platform to the frame.

3. A mason's scaffold suspendable from a building by a plurality of cables comprising:

a. at least two frames, each frame having a pair of vertical members and upper and lower horizontal members extending between and joined to the vertical members to form a generally rectangular frame, the lower horizontal member of each frame being comprised of a vertically oriented plate extending between and joined to the vertical frame members, wherein the vertically oriented plate of each lower horizontal member defines at least one hole therethrough;

b. at least one standard platform extending between the frames, the standard platform having hooks on the opposite end thereof that rest on and are supported by the lower horizontal members of the respective frames to thereby create a deck between the frames, wherein the hooks of the standard platform rest on and are supported by the vertical plate of the lower horizontal member; and c. at least two platforms fasteners overlying and being secured to respective frame lower horizontal members with the hooks of the standard platform therebetween, wherein the platform fastener comprises:

i. a metal sheet that overlies an associated frame lower horizontal member and the standard platform hooks supported thereon;

ii. at least one generally L-shaped bar joined to the metal sheet and having a free leg that is insertable within the hole in the lower horizontal member vertical plate; and iii. at least one pin slidable within the metal sheet and spaced from the bar to cooperate therewith to positively secure the platform fastener to the lower horizontal member vertical plate and thereby positively retain the standard platform to the frame, so that the standard platforms are positively retained to the frames by the platform fasteners.

4. A mason's scaffold suspendable from a building by a plurality of cables comprising:

a. at least two frames, each frame having a pair of vertical members and upper and lower horizontal members extendinng between and joined to the vertical members to form a generally rectangular frame;

b. at least one standard platform extending between the frames, the standard platform having hooks on the opposite ends thereof that rest on and are supported by the lower horizontal members of the respective frames to thereby create a deck between the frames;

c. at least two platform fasteners overlying and being secured to respective frame lower horizontal members with the hooks of the standard platform therebetween; and d. fairlead means for quiding the cables in the upper horizontal members of the respective frames, wherein the fairlead means comprises:

i. at least one tube incorporated into each frame upper horizontal member;

ii. a block associated with each tube, each block having a first hole therethrough sized to receive a cable; and iii. fastening means for fastening the blocks inside the respective upper horizontal member tubes, so that the standard platforms are positively retained to the frames by the platform fasteners, and so that the first holes in the block provide respective fairleads for the cables.

5. A mason'scaffold suspendable from a building by a plurality of cables comprising:

a. at least two frames, each frame having a pair of vertical members and upper and lower horizontal members extending between and joined to the vertical members to forma generally rectangular frame;

b. at least one standard platform extending between the frames, the standard platform having hooks on the opposite ends thereof that rest on and are supported by the lower horizontal members of the respective frames to thereby create a deck between the frames;

c. at least two platform fasteners overlying and being secured to respective frame lower horizontal members with the hooks of the standard platform therebetween; and d. hatch means assembled to the frames over the deck for being selectively closed to provide protection to persons on the deck and opened to enable loading of materials and equipment onto the deck from above, so that the standard platforms are positively retained to the frames by the platform fasteners.

6. The mason's scaffold of claim 5 wherein the hatch means comprises:

a. a pair of end supports assembled to the respective upper horizontal members of two frames; and b. at least one door extending between and pivotally joined to the end supports, the doors being selectively closeable and openable to thereby provide protection and access, respectively, to the deck below.

7. A mason's scaffold suspendable from a building by a plurality of cables comprising:

a. at least two frames, each frame having a pair of vertical members and upper and lower horizontal members extending between and joined to the vertical members to form a generally rectangular frame, wherein each frame upper horizontal memeber is comprised of a vertically oriented plate extending between and joined to the vertical frame members;

b. at least one standard platform extending between the frames, the standard platform having hooks on the opposite ends thereof that rest on and are supported by the lower horizontal members of the respective frames to thereby create a deck between the frames, wherein the hooks of a standard platform rest on and are supported by the upper horizontal member vertical plates; and c. at least two platform fasteners overlying and being secured to respective frame lower horizontal members with the hooks of the standard platform therebetween, wherein a platform fastener overlies and is secured to each upper horizontal member with the standard platform hooks therebetween to thereby retain the standard platform to the upper horizontal member and provide a protective canopy over the deck, so that the standard platforms are positively retained to the frames by the platform fasteners.

8. A mason's scaffold comprising:

a. a plurality of frames, each frame comprising a pair of spaced vertical members and spaced upper and lower horizontal members joined to the vertical members to form a generally planar four-sided frame;

b. a plurality of elongated standard platforms, each standard platform having opposed ends with hooks thereon, the hooks of each end resting on and being supported by the lower horizontal member of a respective frame to thereby form a longitudinally extending deck between the frames;

c. fastener means overlying a portion of the standard platforms and being unsecured thereto for removably securing to the lower horizontal member of each frame to retain the standard platforms to their respective supporting frames; and d. cable means for suspending the frames from a building or the like.

9. A mason's scaffold comprising:

a. a plurality of frames, each frame comprising a pair of spaced vertical members and spaced upper and lower horizontal members joined to the vertical members to form a generally planar four-sided frame;

b. a plurality of elongated standard platforms, each standard platform having opposed ends with hooks thereon, the hooks of each end resting on and being supported by the lower horizontal member of a respective frame to thereby form a longitudinally extending deck between the frames;

c. fastener means secured to the lower horizontal member of each frame for retaining the standard platforms to their respective supporting frames, wherein the fastener means comprises:

i. a metal sheet overlying the frame lower horizontal member with the hooks of the standard platform supported on the lower horizontal member therebetween;

ii. bar means joined to the metal sheet for engaging the underlying lower horizontal member; and iii. pin means slidable within the metal sheet for cooperating with the bar means to releasably positively secure the metal sheet to the underlying frame lower horizontal member and thereby positively retain the standard platforms to the frame; and d. cable means for suspending the frames from a building or the like.

10. A mason's scaffold comprising:

a. a plurality of frames, each frame comprising a pair of spaced vertical members and spaced upper and lower horizontal members joined to the vertical members to form a generally planar four-sided frame, the lower horizontal member of each frame being comprised of a vertically oriented plate, wherein:

the vertically oriented plate of each lower horizontal member defines at least one hole therethrough;

b. a plurality of elongated standard platforms, each standard platform having opposed ends with hooks thereon, the hooks of each end resting on and being supported by the lower horizontal member of a respective frame to thereby form a longitudinally extending deck between the frames, the hooks of the standard platforms resting on and being supported by the vertical plates of the respective frame lower horizontal members;

c. fastener means secured to the lower horizontal member of each frame for retaining the standard platforms to their respective supporting frames, wherein the fastener means comprises:

i. a metal sheet overlying the lower horizontal member with the standard platform hooks supported by the lower horizontal member therebetween;

ii. at least one L-shaped bar joined to the metal sheet and having a free leg that is received in the hole in the lower horizontal frame member and vertical plate; and iii. pin means slidable within the metal sheet for cooperating with the L-shaped bar to positively secure the platform fastener to the frame and thereby positively retain the standard platforms to the frame; and d. cable means for suspending the frames from a building or the like.

11. A mason's scaffold comprising:

a. a plurality of frames, each frame comprising a pair of spaced vertical members and spaced upper and lower horizontal members joined to the vertical members to form a generally planar four-sided frame;

b. a plurality of elongated standard platforms, each standard platform having opposed ends with hooks thereon, the hooks of each end resting on and being supported by the lower horizontal member of a respective frame to thereby form a longitudinally extending deck between the frames;

c. fastener means secured to the lower horizontal member of each frame for retaining the standard platforms to their respective supporting frames; and d. cable means for suspending the frames from a building or the like, wherein:

i. the cable means comprises at least one cable having a first end tied to the building or the like and a second end winched on the frame for raising and lowering the mason's scaffold along the building or the like; and ii. each frame further comprises fairlead means for guiding the associated cable as the mason's scaffold is winched along the building or the like, wherein the fairlead means comprises:

a tube incorporated into the frame upper horizontal member;

a block having a hole therethrough for slidingly receiving the cable, the block being sized to fit within the tube in the frame upper horizontal member; and means for fastening the block inside the upper horizontal member tube, so that the cable is readily assembled to the frame and can slide through and be guided within the block.

12. The mason's scaffold of claim 8 further comprising:

a. a plurality of second elongated standard platforms, each second standard platform having opposed ends with hooks thereon, the hooks of each end resting on and being supported by the upper horizontal member of a respective frame to thereby form a longitudinally extending canopy over the deck; and b. second fastener means overlying a portion of the standard platforms and being unsecured thereto for removably securing to the upper horizontal member of each frame to retain the standard platforms to their respective frames.

13. A mason's scaffold comprising:

a. a plurality of frames, each frame comprising a pair of spaced vertical members and spaced upper and lower horizontal members joined to the vertical members to form a generally planar four-sided frame;

b. a plurality of elongated standard platforms, each standard platform having opposed ends with hooks thereon, the hooks of each end resting on and being supported by the lower horizontal member of a respective frame to thereby form a longitudinally extending deck between the frames;

c. fastener means secured to the lower horizontal member of each frame for retaining the standard platforms to their respective supporting frames;

d. cable means for suspending the frames from a building or the like;

e. a plurality of second elongated standard platforms, each second standard platform having opposed ends with hooks thereon, the hooks of each end resting on and being supported by the horizontal member of a respective frame to thereby form a longitudinally extending canopy over the deck; and f. second fastener means secured to the upper horizontal member of each frame for retaining the standard platforms to their respective frames, wherein the second fastener means comprises:

i. a metal sheet overlying the upper horizontal member with the hooks of the second standard platforms supported on the upper horizontal member therebetween, the metal sheet having at least one slot therein for passage of the cable means;

ii. bar means joined to the metal sheet for extending along the first side of and engaging the frame upper horizontal member vertical plate; and iii. pin means slidingly received within the metal sheet and extending along the second side of the frame upper horizontal member vertical plate for cooperating with the bar means to releasably positively secure the metal sheet to the underlying upper horizontal member and thereby positively retain the second standard platforms to the frame.

14. A mason's scaffold comprising:

a. a plurality of frames, each frame comprising a pair of spaced vertical members and spaced upper and lower horizontal members joined to the vertical members to form a generally planar four-sided frame;

b. a plurality of elongated standard platforms, ech standard platform having opposed ends with hooks thereon, the hooks of each end resting on and being supported by the lower horizontal member of a respective frame to thereby form a longitudinally extending deck between the frames;

c. fastener means secured to the lower horizontal member of each frame for retaining the standard platforms to their respective supporting frames;

d. cable means for suspending the frames from a building or the like; and e. hatch means assembled to and extending between at least two frames for selectively providing overhead protection for the deck and enabling items to be loaded on the deck from above.

15. The mason's scaffold of claim 14 wherein the hatch means comprises:

a. an end support assembled to the respective upper horizontal members of two adjacent frames; and b. door means pivotally joined between the end supports for selectively closing to provide overhead protection for the deck and opening for providing access to the deck from above the scaffold.

16. A platform fastener comprising:

a. an elongated metal sheet;

b. at least one generally L-shaped bar having a fixed leg welded to the metal sheet and a free leg; and c. a pin associated with the bar and being slidable within the metal sheet and being generally parallel to the bar fixed leg, the pin being located at a predetermined distance from the bar such that the bar fixed leg and the pin lie on opposite sides of a selected member and the bar free leg engages a hole in the selected member to releasably secure the platform fastener to the selected member.

17. In combination with an elongated member having opposed fist and second sides with at least one hole extending between the first and second sides, a platform fastener comprising:

a. a metal sheet overlying the member;

b. at least one generally L-shaped bar having a first leg welded to the metal sheet and located proximate the member first side, the bar having a free leg that is received in the hole in the member; and c. a pin slidable received in the metal sheet and located proximate the member second side, the pin cooperating with the bar to positively secure the platform fastener to the member.

18. A method of assembling a mason's scaffold comprising the steps of:

a. providing at least two frames having respective upper and lower horizontal members and vertical members, each upper and lower horizontal member having at least one hole therein;

b. supporting the hooks on the opposed ends of at least one standard platform on the lower horizontal members of respective frames;

c. overlying the lower horizontal member of each frame with a respective platform fastener with the associated standard platform hooks therebetween, wherein the step of overlying the lower horizontal member of each frame with a platform fastener comprises the step of providing a platform fastener having a metal sheet with a top side and an underside, a generally L-shaped bar welded to the metal sheet underside, and a pin slidable within the metal sheet between the top side and the underside and generally parallel to the bar; and d. securing the platform fasteners to the respective frame lower horizontal members to thereby retain the standard platforms to the frames and create a deck.

19. The method of claim 18 wherein the step of securing the platform fasteners to the respective frame lower horizontal members comprises the steps of:

a. placing a platform fastener metal sheet on the standard platform with the bar proximate one side of the associated frame lower horizontal member;

b. sliding the pin to a first position such that the pin is on the top side of the metal sheet;

c. engaging the bar free leg with the hole in the frame lower horizontal member; and d. sliding the pin to a second position on the underside of the metal sheet and on the opposite side of the frame lower horizontal member at the bar to thereby secure the platform fastener to the frame lower horizontal member.

20. A method of assembling a mason's scaffold comprising the steps of:

a. providing at least two frames having respective upper and lower horizontal members and vertical members, each upper and lower horizontal member having at least one hole therein;

b. supporting the hooks on the opposed ends of at least one standard platform on the lower horizontal members of respective frames;

c. overlying the lower horizontal member of each frame with a respective platform fastener with the associated standard platform hooks therebetween;

d. securing the platform fasteners to the respective frame lower horizontal members to thereby retain the standard platforms to the frames and create a deck;

e. supporting the hooks on the opposed ends of at least one standard platform of the upper horizontal members of respective frames;

f. overlying the upper horizontal members of the frames with respective platform fasteners with the associated standard platform hooks therebetween; and g. securing the platform fasteners to the respective frame upper horizontal members to thereby retain the standard platforms to the frames and create a protective canopy for the deck.

21. A method of assembling a mason's scaffold comprising the steps of:

a. providing at least two frames having respective upper and lower horizontal members and vertical members, each upper and lower horizontal member having at least one hole therein;

b. supporting the hooks on the opposed ends of at least one standard platform on the lower horizontal members of respective frames;

c. overlying the lower horizontal member of each frame with a respective platform fastener with the associated standard platform hooks therebetween;

d. securing the platform fasteners to the respective frame lower horizontal members to thereby retain the standard platforms to the frames and create a deck;

e. providing a hatch having a pair of spaced supports assembled to the upper horizontal members of respective frames and at least one door pivotally mounted to the supports; and f. selectively closing the hatch door to thereby form a protective canopy over the deck and opening the hatch door to thereby enable material and equipment to be loaded onto the deck from above.

* * * * *